United States Patent [19]

Zamiska et al.

[11] 4,401,542

[45] Aug. 30, 1983

[54] METAL FINISHING BARREL

[75] Inventors: Frank P. Zamiska, Cleveland; Norman B. Tipton, Avon Lake, both of Ohio

[73] Assignee: The Harshaw Chemical Company, Cleveland, Ohio

[21] Appl. No.: 267,712

[22] Filed: May 28, 1981

[51] Int. Cl.[3] ..... C25D 17/04; C25D 17/20

[52] U.S. Cl. ..... 204/213

[58] Field of Search ..... 204/213; 220/5 R, 71, 220/80; 134/153, 157, 159

[56] References Cited

U.S. PATENT DOCUMENTS

| | | | |
|---|---|---|---|
| 76,890 | 4/1868 | Cartwright | 220/62 |
| 2,182,201 | 12/1939 | Harris | 266/262 |
| 2,741,461 | 4/1956 | Colclesser | 220/80 |
| 2,775,361 | 12/1956 | Kasdan | 220/4 F |
| 2,823,821 | 2/1958 | Frater et al. | 220/4 F |
| 2,836,400 | 5/1958 | Jackson | 220/5 R |
| 3,008,893 | 11/1961 | Belke et al. | 204/213 |
| 3,261,493 | 7/1966 | Smith | 217/65 |
| 3,311,203 | 3/1967 | Pickard | 220/71 X |

FOREIGN PATENT DOCUMENTS

| | | | |
|---|---|---|---|
| 2729525 | 1/1979 | Fed. Rep. of Germany | 204/213 |

*Primary Examiner*—G. L. Kaplan
*Assistant Examiner*—N. X. Nguyen
*Attorney, Agent, or Firm*—Watts, Hoffman, Fisher & Heinke Co.

[57] ABSTRACT

A metal finishing barrel having a body section 10 extending between a pair of end caps 12, that includes a sidewall comprising a plurality of wall sections 14, 16 joined edge-to-edge. In one embodiment, the wall sections are formed from a single, continuous sheet member 44, bent along lines of weakness in the form of V-shaped notches 46 that each define a relatively thin, hinge-like bridging section **46*a* that connects adjacent wall sections. External locking ribs 50 coengage edge portions of adjacent wall sections to maintain the sheet member in its assembled configuration. Alternately, individual wall panels 14', 16' are fabricated with beveled edge surfaces 46'** and are secured in edge confronting engagement by the external locking ribs. In an alternate embodiment, an internal locking rib is employed that also serves as a tumbling rib and coengages locking grooves formed on inside surfaces of edge portions of each wall section.

15 Claims, 8 Drawing Figures

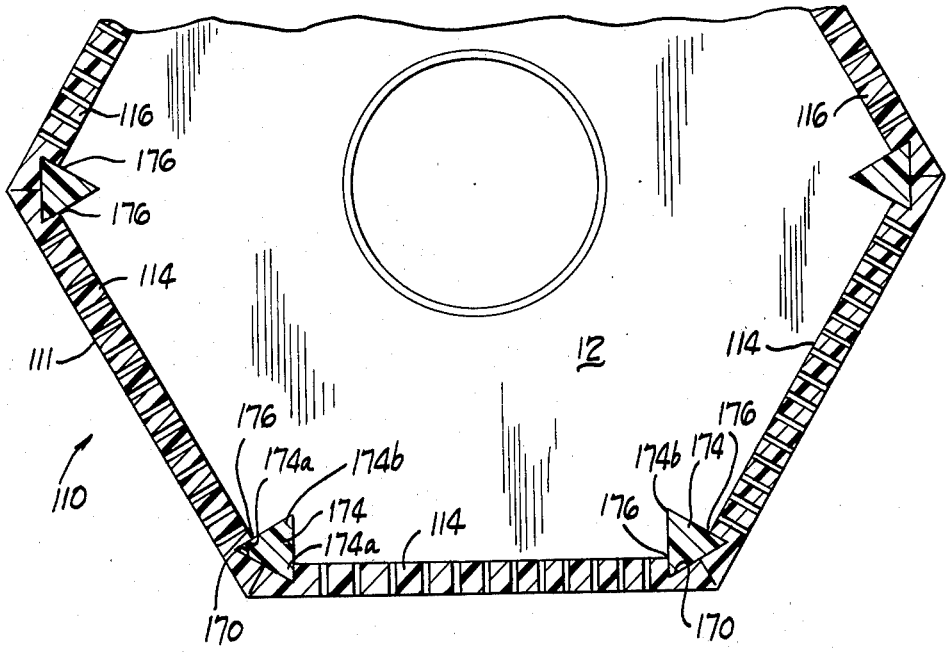
Fig. 4
Fig. 5
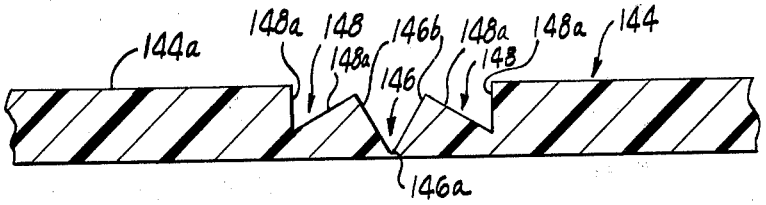
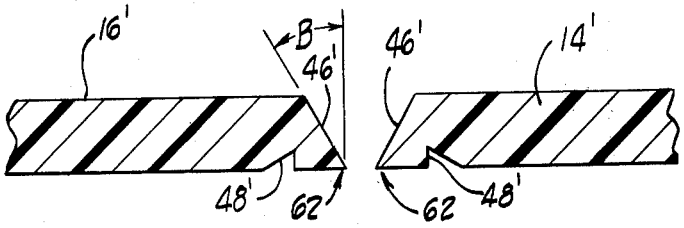
Fig. 3A

METAL FINISHING BARREL

DESCRIPTION

1. Technical Field

The present invention relates generally to metal finishing processes and in particular to a metal finishing container for transporting items through the metal finishing process.

2. Background Art

In metal finishing processes such as electroplating, phosphating, anodizing, cleaning, washing, etc., a container, more commonly called a barrel, is filled with items to be treated and then carried through the processing line by a conveyor system or return barrel machine. The barrel is sequentially submerged into a variety of solution tanks and while submerged, is usually rotated to maximize the exposure of the items to the solution.

A metal finishing barrel generally comprises a perforate body section that extends between a pair of end caps or "heads". In general, the body section comprises either a continuous, arcuate wall panel having a circular cross-section, as illustrated in U.S. Pat. No. 3,439,900 or a plurality of planar wall panels joined to longitudinal ribs to form a body section having a hexagonal cross-section, as illustrated in U.S. Pat. No. 3,394,071. With either construction, an access opening is defined by the body section through which parts are loaded and unloaded from the barrel and which is adapted to receive a removable access door, an example of which is disclosed in U.S. Pat. No. 3,507,529.

In order to withstand the corrosive nature of some of the metal finishing processes, the barrels are usually constructed from a plastic material such as polypropylene or other corrosion resistant material such as stainless steel. A considerable amount of machining and fabrication time is needed to construct either type of barrel. To insure integrity and strength, all components that make up the barrel assembly are usually welded together.

In the currently available barrel that includes individual planar wall members to form the body section, adjacent wall panels coengage a longitudinal rib disposed between the edges of the panels. The interlocking between the edges of the panel and the rib is achieved by machining the edges of the wall panels into a dovetail configuration and machining complementary dovetail notches in the rib. The body section of the barrel is formed by interlocking five contiguous wall panels to four longitudinal, mating ribs. After the components are assembled, the panels are welded to the ribs and the entire body section then welded between the barrel heads.

Although the above disclosed barrel fabrication method provides an extremely rigid, reliable barrel construction that has been commercially successful, a less costly barrel construction has been desired. Alternate, less expensive barrel designs may have been proposed in the past, but none appear to have been readily accepted by the metal finishing industry. Although the dove-tail joint between the wall panels and the rib provide an extremely rigid, reliable interconnection, the machining steps required to form the requisite dovetail tenon along the edge of each wall panel and the mating mortise in the ribs is time-consuming and costly.

DISCLOSURE OF THE INVENTION

The present invention provides a new and improved metal finishing barrel and method of fabrication that reduces machining and assembly time without sacrificing barrel strength. Moreover, the improved barrel includes increased wall panel surface area for providing a larger fluid transfer rate through the barrel thereby improving processing speeds and barrel drainage.

According to the broad aspects of the invention, the improved metal finishing barrel comprises a plurality of wall sections joined in an edge confronting relationship to define a sidewall for the barrel body section, preferably hexagonal in cross-section, that extends between a pair of barrel heads. The wall sections are preferably perforate to allow the free flow of processing solutions through the barrel. An opening is defined in the body section that is adapted to receive a suitable access door which is removed to load and unload the metal finishing barrel.

In accord with the invention, the expensive dovetail construction of the prior art is eliminated and replaced by a simplified tongue-and-groove arrangement for achieving edge-to-edge interlocking of adjacent wall sections. Unlike the prior art, edge surfaces defined on edge portions of adjacent wall panels directly abut each other rather than coengaging opposite sides of a support rib. In the disclosed construction, the edge surfaces of adjacent wall sections are maintained in confronting engagement by a reinforcing rib that coengages the adjacent sections and overlies their juncture.

In the preferred embodiment, the wall sections are formed from a single, continuous, preferably perforate, sheet member, having inside and outside planar surfaces, which are is into the sidewall by bending portions of the sheet along one or more lines of weakness, the number of lines of weakness being a function of the number of panels to be formed from the sheet. According to this embodiment, the lines of weakness are defined by spaced, parallel V-shaped notches extending between side edges of the sheet. The notches preferably define a 60° angle and extend through a substantial thickness of the material so that only a relatively thin section of material connects or bridges two adjacent wall sections. A pair of relatively shallow grooves is formed in one of the planar surfaces, a spaced distance from and on either side of the line of weakness defined by the V-shaped notch. To form adjacent wall sections, the sheet member is bent or folded along the line of weakness until the notch surfaces are brought into confronting, abutting engagement.

The adjacent wall sections are maintained in the folded configuration by self-locking ribs which coengage the shallow grooves formed on either side of the line of weakness. In one embodiment, the grooves are disposed on the outside surface of the sheet and the locking rib includes a slot shaped to receive the corner defined at the juncture of the adjacent wall sections. A pair of laterally extending, tongue-like projections are formed at the base of the slot and are shaped to tightly coengage the shallow grooves formed on either side of the line of weakness. In this embodiment, the rib is characterized as an external locking rib and when mounted, overlies the juncture of the adjacent wall sections. In this configuration, further structural rigidity is provided by welding the adjacent sections together along the inside juncture of the notch surfaces. Alternately, reinforcing ribs that also serve as tumbling ribs, are welded to the inside of the sidewall along the juncture of the adjacent wall sections.

The disclosed metal finishing barrel, substantially reduces fabrication time by eliminating the step of forming dove-tail tenons on the edges of each wall panel and the complementary mortise notches in the support ribs. Instead, simple V-shaped notches are formed in a planar sheet which define the juncture of adjacent wall sections.

In another embodiment, the shallow grooves are formed on the inside surface of the planar sheet spaced from and parallel to the V-shaped notch. In this embodiment, a rib receiving slot is co-defined by the shallow grooves when the sheet is bent along the line of weakness to bring the notch surfaces into confronting engagement. The slot defined at a juncture, is shaped to receive an internal locking rib that includes portions engageable with the locking grooves. In this embodiment, the rib preferably includes a portion that extends towards the interior of the barrel that enhances tumbling when the barrel is rotated during the metal finishing process. In particular, the internal locking rib is preferably triangular in cross-section. The base of the rib is inserted into the slot and preferably bonded to both wall sections thereby securing the adjacent wall sections in a predetermined angular relation.

In an alternate embodiment, the body section is defined by individual, perforate wall panels arranged in a edge-to-edge, confronting relationship, the juncture of which, being maintained by the external locking rib which engages shallow notches formed in edge portions of each wall panel, specifically located on the outside surface of each wall panel. In order to provide the proper angular relationship between adjoining panels, the edges of the panels are beveled to provide an edge confronting surface that defines a predetermined angle with respect to the planar surface thereby providing a body section having a desired cross-section. For example, if the edge surface defines an angle of substantially 30°, the joined wall panels will define an inside angle of 120° when adjacent panels are brought in edge abutting contact and the body section will be hexagonal in cross-section. The rib engaging grooves formed in each wall panel are spaced a predetermined distance from and parallel to the edges of the panel so that when the panels are in a confronting relationship, the distance between opposite locking grooves will correspond to the distance between the laterally extending tongue-like projections formed in the locking ribs. Structural integrity of the juncture is further enhanced by welding together the inside edges of the adjacent panels or alternately by welding a reinforcing rib to the inside edge portions of adjoining panels, overlying the juncture.

The alternate barrel construction also reduces the fabrication time of the metal finishing barrel. Again, the complicated dove-tail interlocking used by the prior art is replaced by simplified tongue and groove arrangement which only requires the forming of geometrically simple edge surfaces on the wall panels and rib engaging, shallow grooves on the exterior surface of the panels, parallel and spaced from the panel edges.

The disclosed construction not only reduces fabrication time and material cost, but also provides increased wall panel surface area thereby enhancing fluid transfer rates through the barrel during processing and reduces drainage time when the barrel is lifted from the processing tank.

Additional features and a fuller understanding of the invention will be obtained in reading the following detailed description made in connection with the accompanying drawings.

BRIEF DESCRIPTION OF THE DRAWINGS

FIG. 3*a* is a fragmentary sectioned view of a wall panel construction for the barrel illustrated in FIG. 2;

FIG. 4 is a fragmentary, sectional view of a barrel sidewall constructed in accordance with another embodiment of the present invention; and FIG. 5 is a fragmentary, sectional view of a sheet member formed in accordance with the embodiment illustrated in FIG. 4.

BEST MODE FOR CARRYING OUT THE INVENTION

Figure 1:
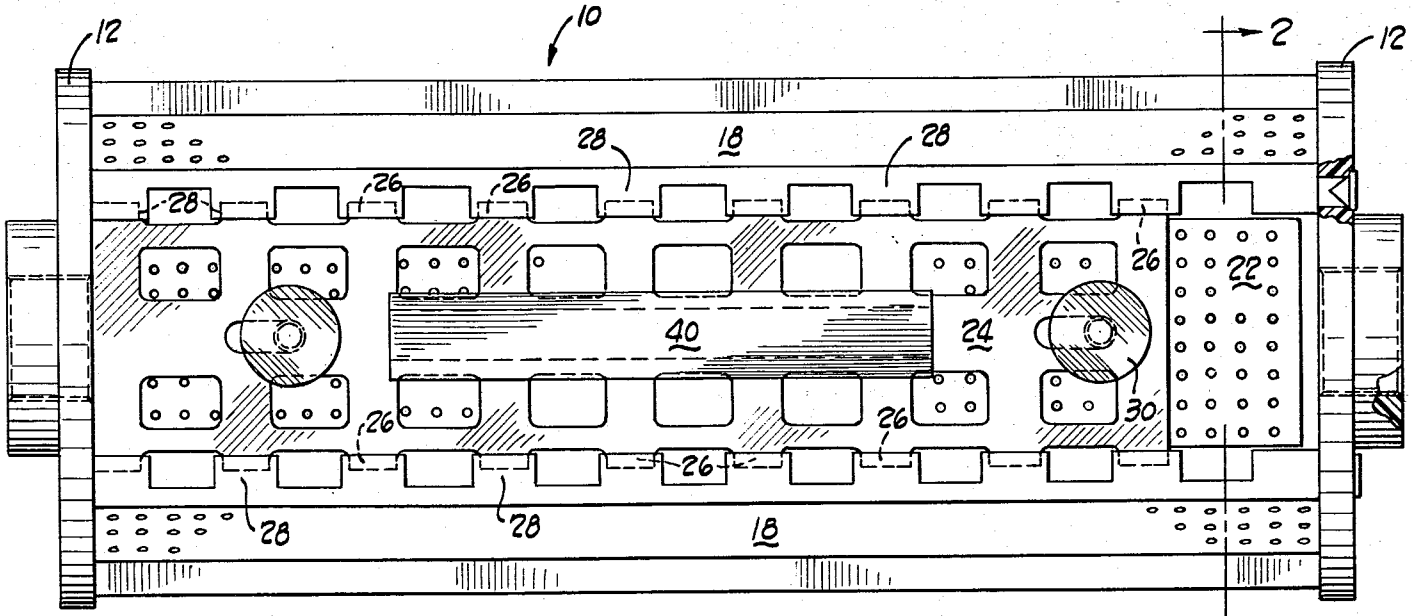
FIG. 1 is an elevational view of a metal finishing barrel constructed in accordance with one embodiment of the invention.
Figure 2:
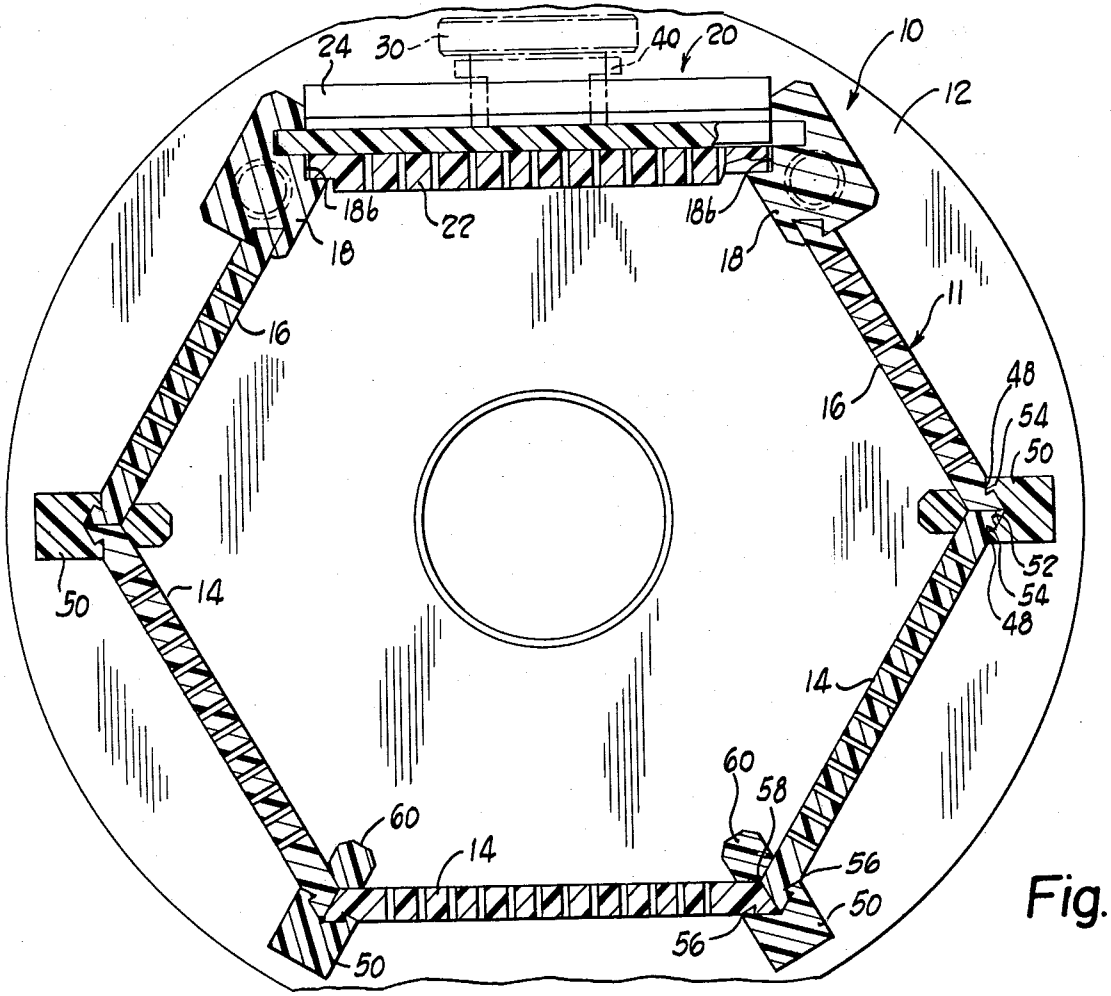
FIG. 2 is a sectional view of the barrel as seen from the plane indicated by the line 2—2 in FIG. 1.

FIGS. 1 and 2 illustrate the overall construction of a metal finishing barrel exemplifying one embodiment of the present invention. The barrel comprises an elongate body section 10 that extends between and is fastened to a pair of barrel heads 12. As is known in the art, a drive gear (not shown) is fastened to the outside of at least one barrel head 12 and is operatively coupled to a drive mechanism (not shown) for rotating the barrel during a metal finishing process.

As seen in FIG. 2, the body section 10 includes a sidewall 11 that comprises a plurality of wall sections 14, 16 joined edge-to-edge to define a hexagonal configuration. The sections 14, 16 are preferably perforate to allow free flow of processing solution through the barrel. The upper wall sections 16 are joined to conventional door support ribs 18 that extend between the barrel heads 12 and which define an access opening through which the metal finishing barrel is loaded and unloaded. The support ribs 18 are configured to receive and engage an access door 20 that serves to fully enclose the volume defined by the body section 10.

As is known in the art, the door 20 includes a perforate closure panel 22, the side edges of which, are received in recesses 18*b* formed in the ribs 18. Referring also to FIG. 1, a slidable latch plate 24 overlies the closure panel 22 and is engageable with locking structure formed in the ribs 18. In the illustrated door, the locking structure comprises a plurality of equally spaced lips 28. The latch plate 24 includes a plurality of equally spaced locking tongues 26 that are engagable with the underside of the lips 28. As more fully explained in U.S. Pat. No. 3,507,529, which is whereby incorporated by reference, the latch plate 24 is first positioned on the closure panel so that its locking tongues 26 are positioned between the lips 28 to enable the access door 22 to be seated on the ribs 18. Once properly seated, the latch plate 24 is moved laterally to position the tongues 26 beneath the lips 28 thereby inter-locking the door 20 to the barrel. Locking knobs 30 are then rotated to lock the position of the latch plate 24 relative to the closure panel 22. An actuating member 40 is suitably fastened to the latch plate to facilitate movement in the latch plate by an operator or by a door opening mechanism.

The access door 20, illustrated and described above, should be considered only as an example of an access door usuable with the present invention. The invention itself is adaptable to a variety of door configurations and constructions and therefore should not be considered limited to the door construction detailed in FIGS. 1 and 2.

Figure 3:
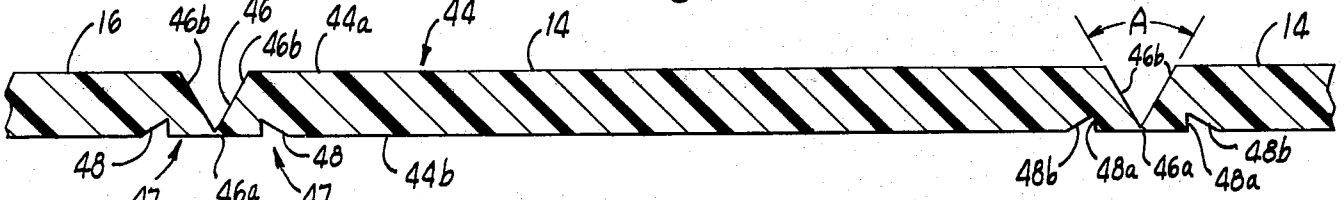
FIG. 3 is a sectional view of a barrel wall panel formed according to the preferred embodiment.

In the embodiment illustrated in FIGS. 1 and 2, the wall sections 14, 16 are secured in an edge confronting arrangement by external locking structure to be described. In a preferred construction of this embodiment, the wall sections 14, 16 are formed from a single, continuous sheet member 44 constructed of suitable material, such as polypropylene. FIG. 3 illustrates the construction of a portion of the sheet member which includes lines of weakness 46 that delimit the individual wall sections. The wall sections 14, 16 are formed by bending the sheet member 44 along the lines of weakness 46.

According to the preferred embodiment, the lines of weakness 46 are formed by V-shaped notches 46, extending across the sheet member 44. In FIG. 3, the notches 46 define the wall sections 16, 14.

The notches 46 extend downwardly (as viewed in FIG. 3) from an inside planar surface **44*a* (which forms the interior surface of the sidewall 11). The notch 46 extends through a substantial thickness of the material leaving only a relatively thin bridging section 46*a* connecting the edge portion 47 of adjacent wall sections. When polypropylene, is used as the base material, it has been found that if the notch depth chosen produces a bridging section 46*a*** that acts as a "living hinge", excellent results are obtained.

According to this embodiment, the notch 46 is defined by notch surfaces **46*b* that merge together at the bridging section 46*a*. A pair of relatively shallow locking grooves 48 are formed on an outside planar surface 44*b* of the sheet member 44 (which forms the exterior surface of the sidewall 10) on either side of the line of weakness formed by the bridging section 46*a*. The grooves 48 are spaced a predetermined distance from and parallel to the bridging section 46*a*. In the embodiment shown, the grooves 48 include a vertically disposed surface 48*a* (as viewed in FIG. 3), substantially orthogonal to the outside surface 44*b* and an angled surface 48*b* that joins the vertical surface 48*a* at a predetermined depth. In the preferred embodiment, the surface 48*b* forms an angle of substantially 90° with the notch surface 46*b***.

To form the sidewall 11, the sheet 44 is bent or folded along each line of weakness **46*a* until the notch surfaces 46*b* are in the confronting relationship shown in FIG. 2. It will be recognized, that the angle defined by adjacent wall sections is determined by the angle of the notches 46. To produce a sidewall having a hexagonal cross section, as illustrated in FIG. 2, a notch angle A of substsantially 60° is needed. With a 60° notch angle, the adjacent wall sections will define an inside angle of substantially 120°. It will be recognized that to produce a body section 10** having other polygonal shapes, suitable modifications to the notch angles A can be made to produce the proper geometric relationship between the wall sections.

Longitudinal external self-locking ribs 50 coengage the edge portions 47 of adjacent wall sections and serve to maintain the folded configuration of the sheet member 44 and also rigidize and strengthen the juncture. The locking ribs 50 are substantially rectangular in cross-section and include a longitudinal slot 52 formed in one face. The slot is shaped to receive the corner defined at the wall section juncture and includes a pair of laterally extending, tongue-like projections 54 engageable with the locking grooves 48 formed on either side of the bridging section **46*a*. In the preferred embodiment, the external locking ribs 50 are inserted over the wall juncture and then bonded (by welding, etc.) to the wall sections. The preferred locations for welding the rib 50 to the wall sections 14, 16 are indicated by the reference character 56**.

To further reinforce and secure the joint, the inside edges of the notch surfaces **46*b* are also bonded, at the location indicated by the reference character 58. Alternately, an internal tumbling rib 60** can be bonded in the inside corner of each wall joint and serves not only to strengthen the juncture, but enhances tumbling of the parts in process, during barrel rotation.

In an alternate construction of the present embodiment, the wall sections 14, 16 comprise individual wall panels joined edge-to-edge. A body section 10 constructed from individual panels, would appear in cross section identical to the construction described above and shown in FIG. 2. The alternate construction differs in that the bridging section **46*a* is omitted. Instead, each panel would include an edge portion, indicated generally by the reference character 62 in FIG. 3*a* that includes a beveled edge surface 46' and a locking groove 48' spaced from and parallel to the edge of the panel. The beveled surface 46' would define an angle B equal to one-half the notch angle A shown in FIG. 3, for a similarly shaped barrel. Thus, to provide a sidewall having a hexagonal cross section, the edge surfaces 48' would define an angle B of substantially 30', as viewed in FIG. 3*a***.

To fabricate a barrel utilizing this alternate construction method, the edge surfaces 46' of the wall panels 14', 16' are placed in edge confronting contact. The locking ribs 50 are then inserted at the outside corners defined at each wall panel juncture and are subsequently bonded to the wall sections at the locations indicated by the reference character 56 in FIG. 2. The adjacent wall panels are then bonded at the inner edges of the juncture as indicated by the reference character 58 or alternately a tumbling rib 60 as described above is bonded to each inside corner.

FIG. 4 illustrates an alternate embodiment of the present invention in which internal locking structure is utilized to maintain the geometric relation between the wall sections that comprise the sidewall. In particular, the alternate embodiment provides a barrel that includes a body section 110 having a sidewall 111 that extends between a pair of barrel end caps 12 (only one end cap 12 is shown). The sidewall 111 comprises a plurality of wall sections 114, 116 that are arranged edge-to-edge to form a body section having a hexagonal cross section. Like the first embodiment described above, the body section defines an access opening (not shown) adapted to receive and engage a suitable access door (not shown). In this alternate embodiment, the wall sections 114, 116 are preferably constructed from a single, continuous sheet of material such as polypropylene. Referring to FIG. 5, the wall sections 114, 116 are formed by bending a sheet member 144 along a line of weakness defined by a V-shaped notch 146. The V-shaped notch extends to a depth slightly less than the thickness of the sheet 144 so that a relatively thin bridging section 146*a* remains to connect the adjacent wall sections 116, 114. The notch 146 is defined by notch surfaces 146*b* which, like the above described embodiment, determine the inside angle of the joined wall sections, when the sheel member 144 is bent. As described above, to form an angle of substantially 120°, the notch angle must be substantially 60°.

A pair of locking grooves 148 are formed on an inside surface 144*a* of the panel 144 on either side of the notch 146. In the preferred construction and as shown in FIG. 5, the locking grooves are defined by a vertical surface 148*a* that extends downwardly from and is orthogonal to the top planar surface 144*a* of the sheet 144 (as viewed in FIG. 5) and an angled surface 148*b* that extends between the bottom of the surface 148*a* and merges with the notch surface 146*b*. Preferably, the angled surface 148*b* defines an angle of 90° with respect to the notch surface 146*b*.

The barrel sidewall 111 is formed by bending the panel 144 at each line of weakness or bridging section 146*a* until the notch surfaces 146*b* are placed in confronting engagement. As seen best in FIG. 4, the locking grooves 148 together define a slot (indicated generally by the reference character 170, when the panels are in the folded configuration. An internal locking rib 174 having wall section engaging portions 174*a* is inserted in the slot 170 to lock and maintain the sections 114 and 116 in the assembled configuration shown. In the preferred embodiment, the rib 174 is triangular in cross section and includes an inwardly projecting portion 174*b* that acts as a tumbling rib to enhance tumbling of the parts contained in the barrel, during barrel rotation. The rib 174 is bonded to the associated wall sections, preferably welded, at the locations indicated by the reference character 176 to provide a strong and reliable wall joint.

In the preferred construction of this embodiment, it has been found that optimum results are obtained if the bringing section 146*a* forms a living hinge. With a living hinge configuration, the bridging section 146*a* remains intact after the wall sections are bent into their assembled configuration and prevents the entry of solution into the wall section joints, thus reducing the amount of solution retained by the barrel that could contribute to process contamination. Additionally, with the bridging section intact, lateral movement between adjacent wall section is prevented thus adding to barrel strength.

Figure 6:
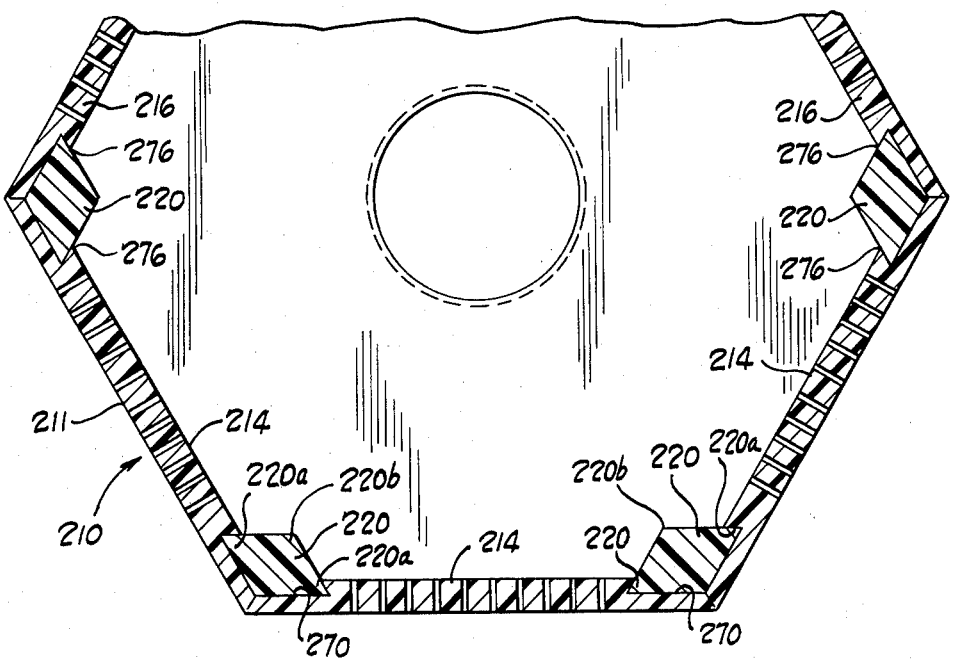
FIG. 6 is a fragmentary, sectional view of a barrel sidewall constructed in accordance with another embodiment of the present invention.
Figure 7:
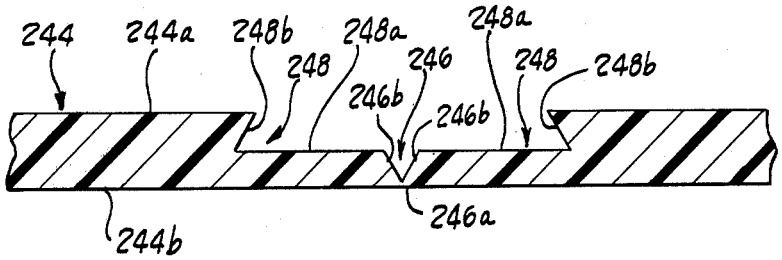
FIG. 7 is a fragmentary, sectional view of a sheet member formed in accordance with the embodiment illustrated in FIG. 6.

FIGS. 6 and 7 illustrate yet another embodiment of the present invention. In this embodiment, adjacent wall panels 214, 216 are locked into the assembled configuration by internal locking ribs 220 which define a polygonal geometric shape such as a parallelogram in cross-section. In the preferred construction of this embodiment, the wall sections 214, 216 are formed from a continuous sheet member 244, the construction of which is shown in FIG. 7. A v-shaped notch 246 defining edge surfaces 246*b* and a bridging section 246*a*, is machined or molded into the sheet member. Internal locking grooves 248 are defined on either side of and merge with the v-shaped notch 146. In this embodiment, the locking grooves 248 each include a laterally extending surface 248*a* that is substantially parallel to an outside surface 244*b* of the sheet member 244 and an inclined surface 248*b* that extends from an inside surface 244*a* down to the lateral surface 248*a*.

When the sheet member 244 is bent along the line of weakness defined by the notch 246 until the edge surfaces 246*b* confrontingly engage, the locking grooves 248, together define a rib receiving slot 270. Referring in particular to FIG. 6, each rib 220 includes corner portions 220*a* which engage the wall sections 214, 216 at the juncture of the locking groove surfaces 248*a*, 248*b* and thus secure the wall sections 214, 216 in the assembled configuration shown in FIG. 6. The ribs are preferably welded to the wall sections at the locations indicated by the reference character 276. The rib 220 preferably includes an internal projecting portion 220*b* that serves as a tumbling rib.

Although a bridging section (i.e. 46*a*, 146*a* or 246*a*) forming a living hinge is preferred, the invention contemplated individual wall sections as well as wall sections joined by frangible bridging sections. For example, a bridging section that fractures or partially fractures as the wall sections are bent along the line of weakness are all considered part of the present invention. In constructions employing frangible bridging sections, or individual wall sections 14, 16, additional bonding steps would probably be needed to seal the wall joints.

It should be apparent that the present invention provides a new and improved metal finishing barrel requiring less fabrication time and material without a reduction in barrel strength. With the present invention, increased sidewall area is achieved thereby allowing increase solution flow through the barrel, when perforate wall sections are employed.

Although the invention has been described with a certain degree of particularity, it is understood that various changes can be made to it by those skilled in the art without departing from the spirit or scope of the invention as described and hereinafter claimed.

I claim:

1. A metal finishing barrel, comprising:

(a) a sidewall extending between a pair of end caps, together defining an interior chamber for receiving products to be processed and including an opening through which products are loaded into said chamber including means for receiving and engaging a removable access door;

(b) said sidewall including at least two adjacent wall sections joined at a predetermined angle, said wall sections formed from a substantially continuous sheet member having an outside and an inside planar surface, said sheet bent along a line of weakness formed in said sheet; and (c) self-locking reinforcing means coengaging portions of each wall section on either side of said line of weakness, for maintaining said wall sections at said predetermined angle.

2. The metal finishing barrel of claim 1 wherein said line of weakness comprises a V-shaped notch formed in said sheet member.

3. The barrel of claim 1 wherein said wall section portions engaged by said self-locking reinforcing means comprise a groove disposed at each wall section, located parallel to and spaced from said line of weakness.

4. The metal finishing barrel of claim 1 wherein each wall section includes a groove formed in the outside surface of said sheet, spaced from and parallel to said line of weakness and said self-locking reinforcing means comprises a rib including laterally extending projections engageable with the grooves formed in adjacent wall sections, said rib overlying the outside of said line of weakness.

5. The apparatus of claim 1 wherein each wall section includes a groove formed on the inside surface of said sheet member, spaced from and parallel to said line of weakness and said self-locking reinforcing means comprises a rib including portions engageable with said grooves, said rib extending between edge portions of said adjacent wall sections and overlying the inside of said line of weakness.

6. The metal finishing barrel of claim 5 wherein said rib includes a portion extending into the interior of said barrel to provide a means for enhancing tumbling of parts in process, during barrel rotation.

7. The metal finishing barrel of claim 1, wherein said line of weakness is formed by a V-shaped notch extending from an inside surface of said sheet to a predetermined depth, said notch defining beveled edge surfaces that are placed in confronting engagement when said sheet is bent along said line of weakness, said beveled edge surfaces determining said predetermined angle defined by said adjacent wall sections.

8. The metal finishing barrel of claim 1, wherein each wall section includes a groove formed in an edge portion spaced from and parallel to said line of weakness such that when said sheet is bent along said line of weakness, the grooves formed in adjacent wall sections define a rib receiving slot in which an internal rib is inserted and bonded, to maintain the angular relationship between said adjacent wall panels.

9. The metal finishing barrel of claim 8 wherein said internal rib is triangular in cross-section.

10. The metal finishing barrel of claim 1 wherein said continuous sheet member is perforate to allow solution to flow through said barrel.

11. A metal finishing barrel comprising:

(a) a sidewall extending between a pair of end caps, together defining an interior chamber for receiving products to be processed, said sidewall defining an access opening through which said barrel is loaded including means for receiving and engaging a removable access door;

(b) said sidewall comprising a plurality of wall sections joined to each other in an edge-to-edge confronting relationship;

(c) each wall section including an edge portion defining structure confrontingly engageable with structure formed in the end portion of an adjoining wall section;

(d) each edge portion defining a beveled edge surface and a groove formed on the outside surface of said wall section spaced from and parallel to said beveled edge surface, said edge surfaces determining the angular relationship of adjoining wall sections, when the edge surfaces of adjoining wall sections are placed in confronting relation;

(e) self-locking ribs engageable with the grooves formed in the edge portions of adjoining wall sections operative to lock and maintain said adjoining wall sections in said predetermined angular relationship; and, (f) said adjoining wall sections being joined by a relatively thin bridging section that extends between the edge portions of the adjoining wall sections.

12. The metal finishing barrel of claim 11 wherein said relatively thin bridging section forms a living hinge.

13. A metal finishing barrel comprising:

(a) a sidewall extending between a pair of end caps, including a plurality of wall sections formed from a substantially, continuous perforate sheet defining inside and outside planar surfaces;

(b) said wall sections formed by bending said continuous sheet inwardly, along parallel lines of weakness disposed in said sheet;

(c) said lines of weakness defined by notches extending transversely between opposite edges of said sheet, said notches being substantially V-shaped in cross-section and including notch defining surfaces that begin at said inside surface of said sheet and terminate and merge at a predetermined depth, thereby defining a relatively thin bridging section that hingedly attaches adjacent wall sections;

(d) said adjacent wall sections folded along said lines of weakness until said notch defining surfaces abut to form a juncture for adjacent wall sections from which said sections extend at a predetermined angle determined by the angle of said notch surfaces;

(e) structure formed on the outer surface of said sheet on either side of said line of weakness engageable with a self-locking reinforcing means for rigidizing said juncture and for maintaining said confronting engagement between said notch surfaces thereby securing said wall sections at said predetermined angle.

14. The metal finishing barrel of claim 11 or 13 wherein said sidewall is fabricated from polypropylene.

15. A metal finishing barrel comprising:

(a) a sidewall extending between a pair of end caps, including a plurality of wall sections formed from a substantially, continuous perforate sheet defining inside and outside planar surfaces;

(b) said wall sections formed by bending said continuous sheet inwardly, along paralel lines of weakness disposed in said sheet;

(c) said lines of weakness defined by notches extending transversely between opposite edges of said sheet, said notches being substantially V-shaped in cross-section and including notch defining surfaces that begin at said inside surface of said sheet and terminate and merge at a predetermined depth, thereby defining a relatively thin bridging section that hingedly attaches adjacent wall sections;

(d) said adjacent wall sections folded along said lines of weakness until said notch defining surfaces abut to form a juncture for adjacent wall sections from which said sections extend at a predetermined angle determined by the angle of said notch surfaces;

(e) V-shaped grooves formed on the outer surface of said sheet on either side of said line of weakness;

(f) said grooves formed on either side of said line of weakness engageable with a self-locking reinforcing rib, said rib including a longitudinal slot for receiving said juncture of adjacent wall sections and further including a pair of laterally extending, tongue-like projections positively engageable with said grooves for maintaining said rib and said adjacent wall sections in assembled position.

* * * * *